US005277654A

United States Patent [19]

Fenn et al.

[11] Patent Number: 5,277,654

[45] Date of Patent: Jan. 11, 1994

[54] METHOD AND APPARATUS FOR PROTECTIVELY TRANSPORTING CONTAMINATED PERSONNEL AND THE LIKE

[75] Inventors: John H. Fenn, Long Beach, N.Y.; Roy Niklasson, East Wallingford, Vt.

[73] Assignee: John's Insulation, Inc., Long Island City, N.Y.

[21] Appl. No.: 958,296

[22] Filed: Oct. 8, 1992

[51] Int. Cl.[5] ..... F24F 7/007

[52] U.S. Cl. ..... 454/141; 454/187; 55/356; 55/385.1

[58] Field of Search ..... 55/356, 385.1, DIG. 24; 135/91, 93, 900; 454/141, 187, 251, 49

[56] References Cited

U.S. PATENT DOCUMENTS

| | | | |
|---|---|---|---|
| Re. 33,810 | 2/1992 | Strieter | 134/99 |
| 3,766,844 | 10/1973 | Donnelly et al. | 55/385.2 |
| 3,777,736 | 12/1973 | Van Der Waaij et al. | 454/187 X |
| 4,534,389 | 8/1985 | Tullis | 141/98 |
| 4,581,986 | 4/1986 | Conklin et al. | 454/187 |
| 4,667,580 | 5/1987 | Wetzel . | |
| 4,706,551 | 11/1987 | Schofield | 454/187 X |
| 4,732,592 | 3/1988 | Spengler | 55/356 |
| 4,741,256 | 5/1988 | Huang | 454/141 |
| 4,870,895 | 10/1989 | Mayer | 454/141 X |
| 4,883,512 | 11/1989 | Griffis | 55/356 |
| 4,928,581 | 5/1990 | Jacobson | 454/49 X |
| 4,964,899 | 10/1990 | Griffis | 55/356 |
| 5,080,701 | 1/1992 | Howard et al. | 55/356 |
| 5,123,874 | 6/1992 | White, III | 454/251 |
| 5,205,782 | 4/1993 | Ohba | 454/141 |

FOREIGN PATENT DOCUMENTS

| | | | |
|---|---|---|---|
| 2151434 | 4/1973 | Fed. Rep. of Germany | 454/141 |
| 233231 | 9/1988 | Japan | 454/187 |

*Primary Examiner*—Harold Joyce
*Attorney, Agent, or Firm*—Louis Weinstein

[57] ABSTRACT

Portable, wheeled apparatus for transporting two or more contaminated asbestos workers to a remote decontamination facility after performing asbestos removal. The portable device is wheeled and is provided with a brake to selectively prevent rolling. A fiberglass shell is mounted upon a rugged angle iron frame and is provided with a window along one side. A hingedly connected door is preferably provided with a window and has a gasket to provide an air-tight seal. Internally mounted door latches permit locking and opening from the interior. An air inlet is provided with a HEPA filter and fan to create positive pressure within the enclosure. An exhaust port is provided at the top end and is also fitted with a HEPA filter. A sealing flap extends around the people carrier door and is provided with a Velcro surface for attachment to a cooperating Velcro surface on the decontamination chamber as well as the work area. A Velcro strip on the opposite side of the closure flap and a cooperating Velcro strip provided on the carrier serves to retain the flap flush against the people carrier when not in use. A push handle is provided at the end of the people carrier opposite the door. A rechargeable battery is mounted within the people carrier to power the fan and may be plugged into a suitable AC outlet for recharging when not in use.

18 Claims, 4 Drawing Sheets

METHOD AND APPARATUS FOR PROTECTIVELY TRANSPORTING CONTAMINATED PERSONNEL AND THE LIKE

FIELD OF THE INVENTION

The present invention relates to removal of harmful materials such as asbestos and the like, and more particularly, to a novel wheeled people mover for isolating and moving contaminated personnel in a protective manner.

BACKGROUND OF THE INVENTION

There are a number of materials, which have been identified as posing significant health hazards to personnel exposed to or coming in contact with such materials.

For example, asbestos has been well-known and recognized for its insulation and fireproof properties and, as a result was widely used as an insulation and/or fireproofing material. In spite of these excellent insulation and fire retardant characteristics, it has been established that airborne asbestos fibers, and other fine particles of asbestos are the cause of a serious disease known as asbestosis as well as causing a type of cancer known as mesothelioma.

Due to the serious health hazards, which may result from continued exposure to asbestos as well as other materials that include fine particulate contaminants, significant efforts have been made, especially throughout the United States, to remove or abate asbestos from buildings and/or any other structures employing asbestos as an insulating and/or fire retardant material. Due to the serious health hazards posed by asbestos, detailed government regulations have been provided to dictate the handling and removal of asbestos as well as the protective measures, which have been promulgated to insure the safety of personnel involved in the removal and/or abatement of such hazardous material as well as isolation of the areas being decontaminated to prevent exposure to uncontaminated areas as a result of the removal and/or abatement of asbestos from contaminated areas.

One conventional apparatus and technique for asbestos abatement and/or removal is disclosed in U.S. Pat. No. 4,604,111, in which an enclosure is created to isolate the region in which asbestos is to be removed. The space is sealed by plastic sheets or the like, an air inlet is provided for the enclosed space to permit air to be drawn into the region, and a filtration unit is employed to provide an air outlet so that fibers and particulate are collected in the filtration unit. A negative air system is utilized to assure that all of the air in the enclosed space is under pressure to leave. However, air only leaves through the filtration unit covering the air outlet to collect dangerous fibers and other particulate.

In order to gain access to the region to be decontaminated, an entrance port is provided. The entrance is selectively sealed by a "flap seal" typically comprised of a plastic sheet, and is designed to form a one-way closure with the aforementioned opening so that air is normally drawn into the enclosed region so long as a negative pressure condition is maintained, and whereby the flap seals the opening as a result of failure or sudden loss of the negative pressure to prevent airborne matter from leaving the enclosed region other than through the filter.

The aforementioned U.S. Pat. No. 4,604,111 also discloses that it is conventional to provide a decontamination unit in close proximity to the contaminated region, such decontamination unit being typically referred to as a "decon" unit, which is conventionally comprised of three adjoining chambers including a "dirty room", shower and clean room enabling personnel to leave the contaminated area and enter into the decon unit to be vacuumed off, and remove protective garments and masks in the dirty room, shower in the shower unit, and dress in the clean room in a manner so that the decon unit isolates the contaminated region. The region connecting the contaminated work area and the decon unit is typically short in length and is isolated from adjacent regions for the protection of the public.

Employing the above technique in job sites such as multi-story, high rise office buildings, factories or the like, necessitates the provision of a decon unit at each work area. In the event that the floor space of each floor is quite large, decon units are typically required at two or more locations on each floor depending on locations of the work areas when employing the techniques of U.S. Pat. No. 4,604,111, thus significantly increasing the capital costs for equipment employed at such job sites.

BRIEF DESCRIPTION OF THE INVENTION

The present invention is characterized by utilizing a technique and equipment for significantly reducing the number of decon units required at a job site such as a multi-story job site or a factory or office floor of large size, where more than one work area is required through the employment of a self-contained wheeled enclosure, which serves as a "people mover", which is capable of transporting contaminated service personnel and is especially advantageous for use in transporting such personnel from a contaminated work area to a decon unit while isolating the transported personnel to prevent contamination of regions between a work space and the decon unit, which are typically unprotected thereby significantly reducing the number of decon units required at a job site while at the same time efficiently and safely moving personnel while isolating contaminated personnel leaving a job site.

The people mover of the present invention is characterized by comprising a rugged, rectangular-shaped, metallic support frame mounted upon wheels and provided with brake means. An enclosure, which is preferably a molded, fiberglass shell is mounted upon the rugged frame and has a substantially perpendicular, parallelepiped shape. One end of the enclosure is provided with a hingedly mounted door. A rubber gasket is mounted either to the perimeter of the door interior or to the exterior of the enclosure adjacent to the marginal portion of the enclosure opening which is sealed by the door, the gasket providing a substantially, air tight seal. A window may be provided in the door, as well as one or more walls of the enclosure opposite the door and/or adjacent to the door. A pushbar is mounted along the wall opposite the door to facilitate movement of the people mover. The brake means is preferably provided with a brake pedal adjacent the side wall having the pushbar.

An air inlet having a HEPA filter and blower is provided in one side wall near the lower end thereof. An exhaust port having a HEPA filter is provided in the roof of the enclosure. A rechargeable battery is retained within a recess having a removable cover, and is provided with a battery charging unit and an extension cord for coupling with a suitable local 110 volt AC source to permit charging the battery when not in use.

The battery powers the fan, which operates in such a manner as to provide a positive air flow to create positive air pressure within the enclosure, the filter means retaining any fibers or particulate.

The door is provided with latches, which permit personnel within the enclosure to open the door from the inside.

An interior light is mounted within the ceiling of the enclosure and is powered by the aforementioned battery.

A flap arrangement is provided at the near end of the enclosure adjacent the entrance door. The flap surrounds the three sides of the enclosure and the bottom of the frame. One surface of the flap is provided with a first type of Velcro strip, which is enabled to be releasably secured to a cooperating second type of Velcro strip arranged about the entrance of the decon as well as the entrance of the contaminated work area.

The flaps are normally retained substantially flush against the surface of the enclosure by means of a cooperating Velcro strip arranged along the two side walls and roof of the enclosure as well as the underside of the frame to neatly maintain the flap against the external surface of the people mover when not in use. In order to utilize the flaps, they are pulled away from the cooperating Velcro strips after the people mover has been moved partially into the work area or decon. The door is arranged to open into the decon and into the work area to retain the aforementioned seal and thereby prevent the escape of contaminants.

The enclosure is provided with a floor drain to facilitate washing and cleaning of the people mover at the end of each day to thoroughly decontaminate the people mover. A cover air-tightly seals the drain openings. The enclosure is preferably formed of a heavy duty fiberglass to ensure airtight containment during transportation as well as being watertight to facilitate washing of the people mover.

The dimensions of the people mover are such as to be capable of transporting two to three workers and further being designed to fit easily through doorways and into elevators. The vehicle is easily movable by a single workman and enables a significant reduction in the number of decon units required as well as preventing unprotected regions through which the people mover travels when being moved from a protected work area to a protected decon area, for example, since personnel may be both rapidly and easily moved in the isolated people mover from work area to decon or vice versa even, for example, on elevators provided at the job site, thereby significantly reducing the number of decon units required at a job site.

OBJECTS OF THE INVENTION

It is therefore one object of the present invention to provide a novel people mover for facilitating the transportation of contaminated work personnel, while at the same time isolating others from the contaminants.

Still another object of the present invention is to provide a novel, lightweight, rugged wheeled enclosure for safely moving personnel between decontamination units and work regions, while preventing the undesirable release of contaminants.

Still another object of the present invention is to provide a novel, people mover having releasable sealing means for creating a temporary seal to prevent the release of contaminants during the time that the people mover is arranged to transfer personnel either between the people mover at a work area or between the people mover and a decon unit.

Still another object of the present invention is to provide a novel, people mover for transporting contaminated personnel between a work site and a decon unit, and which is rugged, lightweight, self-contained and battery powered, and which is easy to use, service and clean.

BRIEF DESCRIPTION OF THE FIGURES

The above as well as other objects of the present invention will become apparent when reading the accompanying description and drawing in which.

DETAILED DESCRIPTION OF THE INVENTION AND PREFERRED EMBODIMENTS THEREOF

Figure 1:
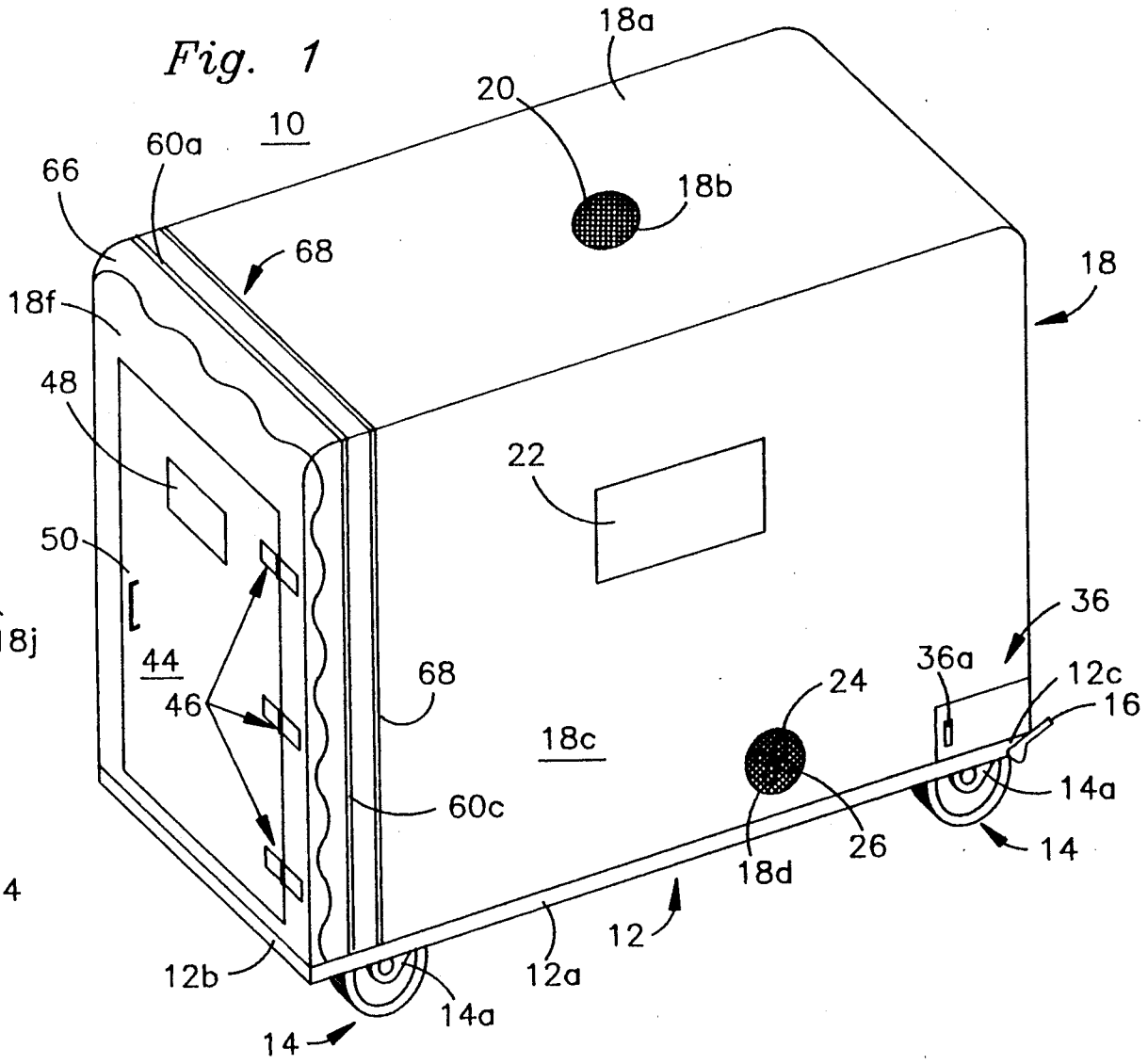
FIG. 1 shows a perspective view of a people mover designed in accordance with the principles of the present invention.
Figure 3:
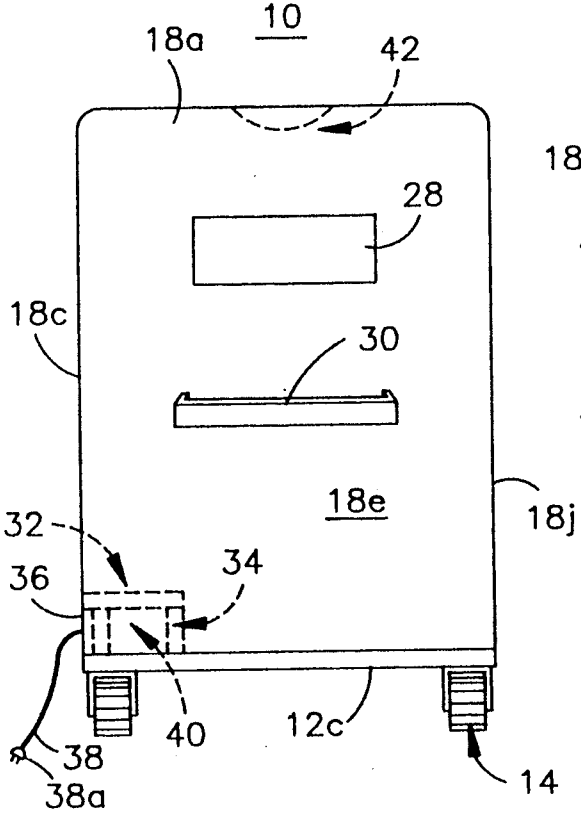
FIG. 3 shows an end view of the people mover of FIG. 1 and looking in the direction of the right-hand end thereof.
Figure 2:
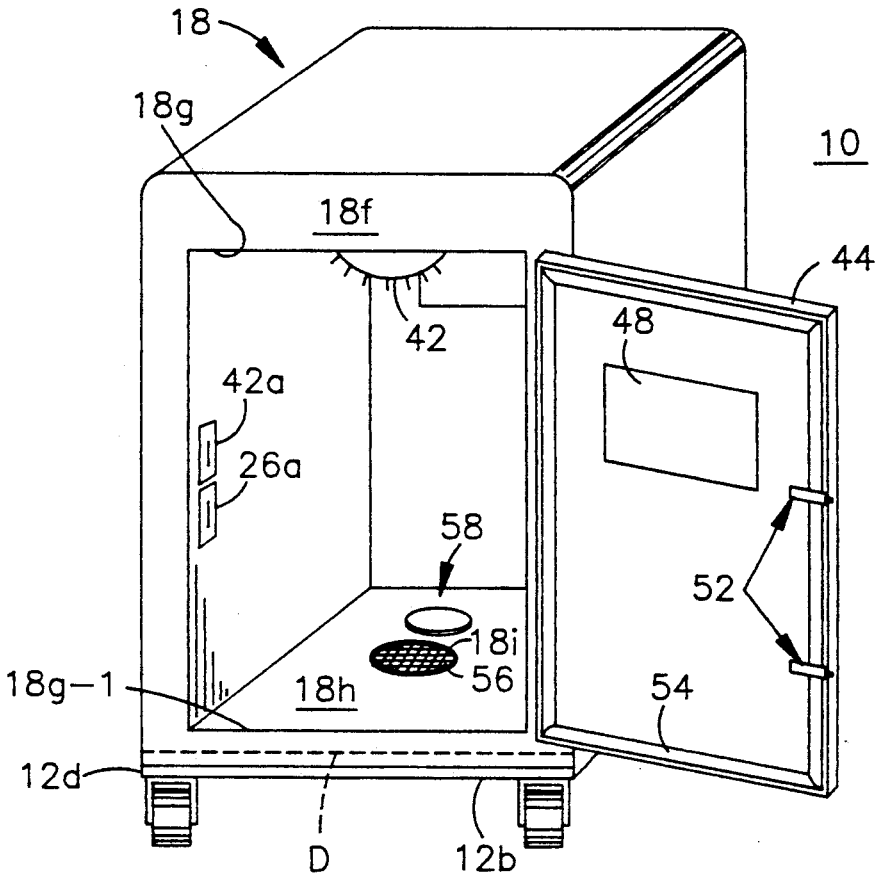
FIG. 2 shows a perspective view of the people mover of FIG. 1 with the door opened to view the interior thereof.

FIGS. 1 through 3 show a transport vehicle or "people mover" 10 designed in accordance with the principals of the present invention and being comprised of a substantial rectangular support frame 12 comprised of a plurality of angle iron members **12*a*–12*d*** (see FIGS. 1–3) which are joined at each of the four corners of the rectangular shaped frame by suitable weldments (not shown).

A suitable wheel assembly 14 is provided adjacent each corner of the assembly 10 and is rigidly secured to frame 12 by suitable wheel brackets **14*a*. Each of the rear wheels is provided with a brake assembly having a foot operated brake pedal 16** adapted to lock at least the rear wheels. Alternatively, the brake assembly, which may be of any suitable design, may be designed to lock all four wheels to prevent movement of the people mover without the need for utilization of holding blocks or other types of holding devices, thus eliminating the need to carry such holding blocks and the need to manually place them in position against each wheel and thereafter to remove the blocks from blocking the wheels.

The people mover is preferably comprised of a one-piece molded fiberglass enclosure or shell 18 of a substantially rectangular parallelepiped shape. The top or roof **18*a* is provided with an opening 18*b* which is preferably fitted with a HEPA filter exhaust structure 20. One side wall 18*c* is provided with a viewing window 22 to enable personnel inside to see out and further to enable personnel outside to view the interior of the enclosure. An opening 18*d* is provided in side wall 18*c* and is fitted with a HEPA filter 24 and motor driven fan 26** whose operation will be described hereinbelow.

End wall 18*e* is provided with a back viewing window 28 and a pushbar 30, which facilitates pushing of the people mover 10 between job site and decon, for example. Handles similar to handle 50 may be provided along side walls 18*c* and 18*j* either as an alternative or in addition to handle 30.

A compartment 32 is provided to receive a 12 volt rechargeable battery 34 accessible through a removable door 36 having a combination door handle/latch 36*a* to gain access to the battery compartment.

An insulated electrical power line 38 is coupled to a charging unit 40 for charging battery 34 and is provided with an electrical plug 38*a* for coupling to a 110 volt AC line, for example. Cord 38 is stored within compartment 32 and may be plugged in to a suitable electrical outlet to recharge the battery 34 when the people mover is not in use.

An internal light 42 is provided along the interior of the enclosure roof 18*a* to illuminate the interior of shell 18. A suitable on/off switch 42*a* is provided near the entrance to the enclosure for selectively powering light 42. A second switch 26*a* positioned in close proximity to switch 42*a* and is provided for selectively powering fan or blower 26.

End wall 18*f* of enclosure 18 is provided with an access opening 18*g*. Door 44 is swingably mounted to enclosure 18 by a plurality of hinges 46. Door 44 has a window 48 and an external handle 50. A pair of door latches 52 are provided along the interior side of door 44. The marginal portion of door 44 adjacent to the periphery thereof is fitted with a substantially rectangular-shaped resilient, compressible gasket 54, which is compressed between door 44 and a marginal portion of the side wall 18*f* surrounding opening 18*g* to provide a substantially airtight seal when the door is in the closed and latched position.

The interior floor 18*h* of enclosure 18 is provided with a drain opening 18*i* and a perforated drain plate 56. A cover 58 preferably threadedly engages a tapped opening 18*i* to normally provide an airtight seal. When it is desired to wash out the interior of enclosure 18, cover 58 is removed. Floor 18*h* is preferably sloped from the outer ends toward the center opening 18*i* to facilitate drainage of the interior. Grate 56 may be omitted, if desired. Also cover 58 may be force-fitted into opening 18*i* to create a suitable air-tight seal.

The people mover 10 is further provided with a releasable closure flap having four flap portions, more particularly an upper and lower flap portion 60*a*, 60*b*, a right-hand flap portion 60*c* and a left-hand flap portion 60*d*. Each flap portion is fixedly secured along one edge portion thereof adjacent to the enclosure. For example, flap portion 60*a* has its edge portion 60*a*-1 fixedly secured to the enclosure 18 and specifically the roof 18*a* by a suitable glue or epoxy, for example. If desired, any other form of joining means may be utilized such as mounting brackets, rivets, staples, clamps or the like.

Each of the other flaps 60*b* through 60*d* are secured to the people mover in a similar fashion. Flap 60*b* is preferably secured to side wall 18*f* in the region below the lower edge 18*g*-1 of opening 18*g*, dotted line D schematically representing the securement line between flap 60*b* and the side wall surface 18*f* of enclosure 18.

Figure 4:
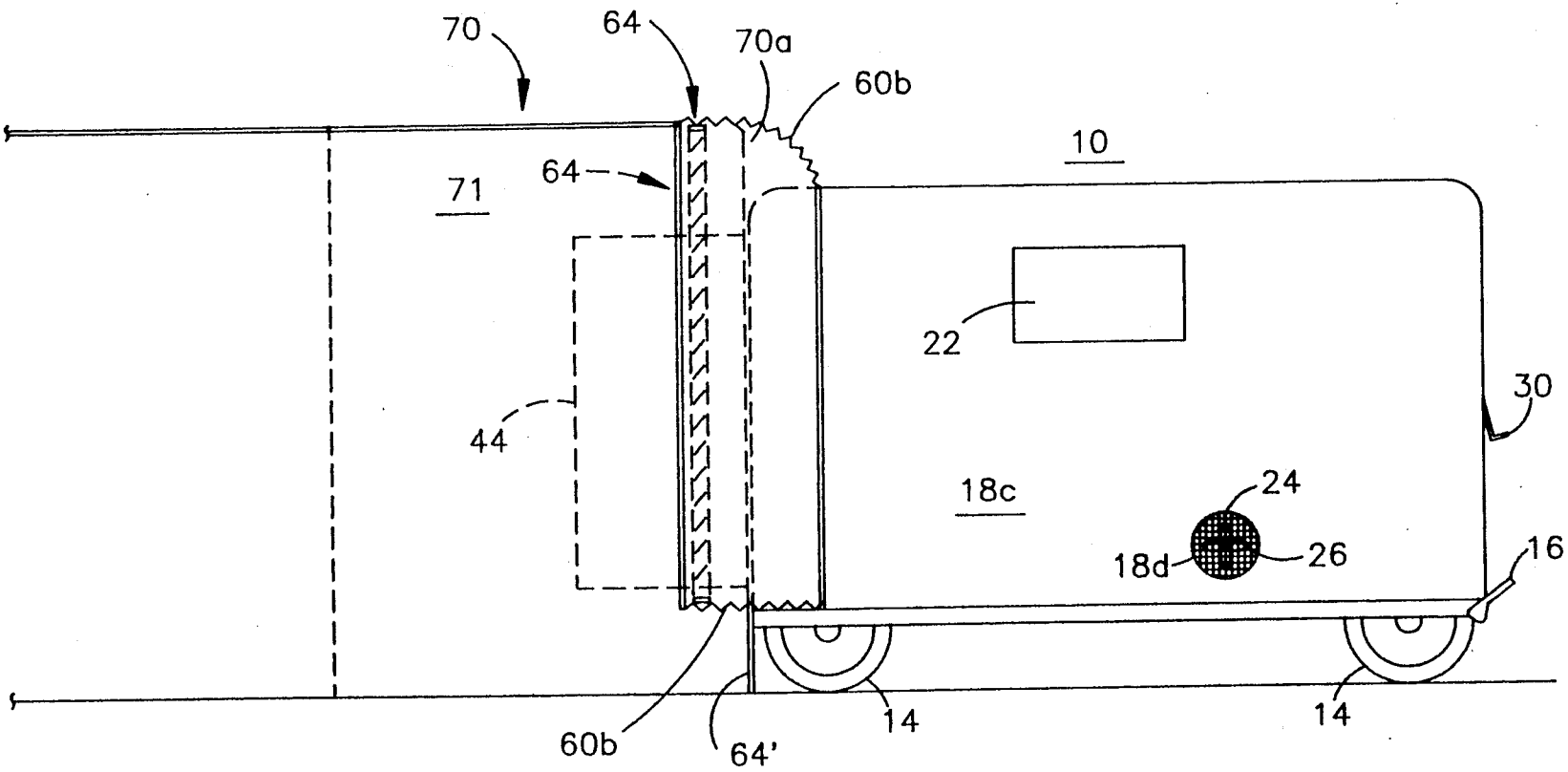
FIG. 4 shows an elevational view of the manner in which the people mover is releasably coupled to a work area.
Figure 5:
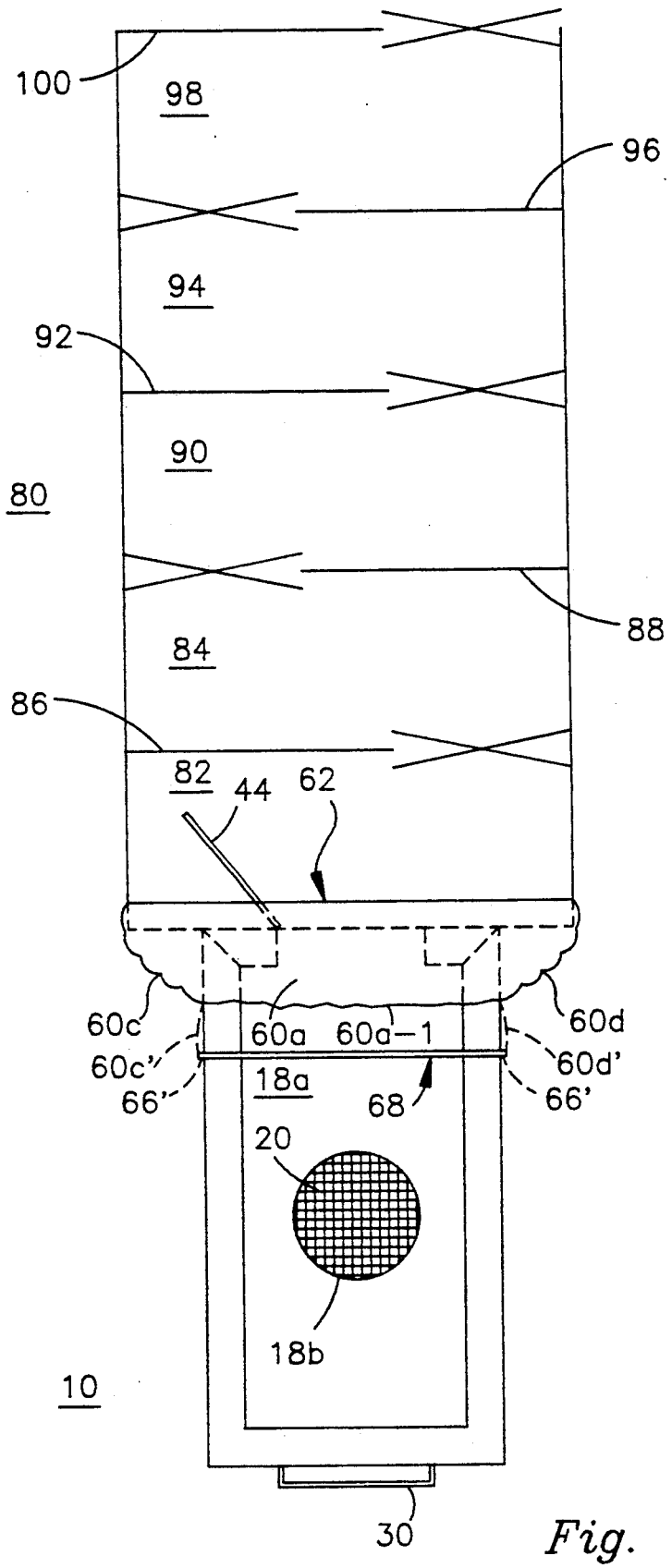
FIG. 5 is a top plan view showing the manner in which a people mover is releasably joined to the entrance of a decon.

At least a marginal portion of both major surfaces of each flap is provided with a Velcro strip, such as, for example, the Velcro strip 62 shown in cross-hatched fashion in FIG. 5. The Velcro strip 62 may be of either the hook-type or the loop-type as is conventional Velcro being a Registered Trademark identifying such interengageable strips of hook-type and loop-type material which may be selectively pressed together and thereafter "peeled" apart. Assuming that the Velcro strip 62 is of the hook-type, a Velcro strip 64 of the loop-type (see FIG. 4) is provided along the surfaces of the work area adjacent to the opening thereof so as to be inter-engaged with the hook-type material 62. In the arrangement in the example shown in FIG. 4, the loop-type strips 64 are arranged along a top wall and three side walls which are adjacent and perpendicular to a front wall 70*a* of work area 70, one such loop-type strip 64' being arranged across the front wall 70*a* just below the bottom edge of the entrance into the work area.

As an alternative, all of the strips 64 may be arranged along the front wall or surface 70*a* in the marginal region surrounding the opening into work region 70, the hook-type Velcro strips of flaps 60*a*–60*d* interengaging with cooperating loop-type strips 64 and 64' equally as well regardless of whether the loop-type strips are arranged along side walls perpendicular to the front wall 70*a* of the work area or are arranged along the exterior surface of the front wall 70*a* in the marginal portion surrounding the opening into the work area.

As shown in FIG. 1, the opposite surface of each flap 60*a*–60*d* is provided with a hook-type Velcro strip 66 (for example) along the outer surface of each flap. The enclosure 18 is further provided with loop-type Velcro strips 68 secured to the exterior surface of enclosure 18 by any suitable adhesive, epoxy, glue or the like and adapted to be interengaged with a cooperating one of the hook-type Velcro strips 66 in order to retain the flaps 60*a*–60*d* substantially flat and flush against the enclosure when the flaps are not in use and when the people mover is being transported, for example. It should be understood that the positions of the loop-type and hook-type strips may be reversed, if desired.

FIG. 5 shows the manner in which the people mover 10 may be releasably joined to a decon unit 80 comprised of first and second airlocks 82 and 84, and closable flap means 86 between airlocks 82 and 84, closable flap means 88 arranged between airlock 84 and dirty room 90, closable flap means 92 arranged between dirty room 90 and shower facility 94, and closable flap means 96 arranged between shower facility 94 and clean room 98, and closable flap means 100 to enable personnel to exit from the clean room 98. The specific construction of decon unit 80 and the work area 70 may be of any suitable design, the detailed construction and configuration thereof being outside the scope of the present invention, it being understood that the work area and decon unit be provided with the cooperating Velcro strips mentioned hereinabove in the vicinity of and surrounding the entrance area thereof in order to interengage with the cooperating flaps of people mover 10 to provide the desired releasable seal in accordance with the present invention.

The manner of operation is as follows.

Let it be assumed that it is desired to move personnel from work area 70 (FIG. 4) to decon unit 80, which is arranged at a remote location from work area 70 such as, for example, at the far end of a floor or arranged on a floor of a multi-story building which is different from the floor on which the work area 70 is located.

The work area 70 is maintained at a negative pressure and is preferably provided with a flap seal opening of the type described in the aforementioned '111 patent. The flap seal opening opens into an air lock chamber 71 similar in design and function to the air lock 82 of decon unit 80. The personnel within the work area are typically provided with protective clothing and masks to be protected against contamination. Nevertheless, the protective clothing and masks typically become contaminated with asbestos fibers and other particulate due to intimate contact of the worker with the asbestos being removed. In order to safely transport such personnel without endangering unprotected areas or regions other than the protected work area 70 and the protected decon unit 80, people mover 10 is moved so that the end thereof containing door 44 is positioned immediately adjacent the flap seal of the work area 70. The brake may be engaged when the people mover is properly positioned. The flaps 60*a*–60*d*, when not in use, are held substantially flush against the exterior surface of people mover 10 by means of the loop-type Velcro strips 68, which interengage with the hook-type Velcro strips shown at 66' in FIG. 5.

The flaps are pulled or "peeled" away from the dotted positions 60*a*'–60*d*', disengaging the hook-type material strips provided along one surface of the flaps 60*a*–60*d* from the loop-type strips 68 provided along the exterior of the people mover 10. Flaps 60*a*–60*d*, after being disengaged from the strips 68, are then compressed against the surfaces of the work region 70 carrying the cooperating loop-type strips 64 and 64', creating a seal between people mover 10 and the work area 70. Door 44 may then be opened into the air lock 71 provided at the entrance to the work area to enable the contaminated personnel to enter. It should be noted that door 44 opens into the work area air lock to assure that the seal between the work area and the people mover is unaffected. The contaminated personnel enter enclosure 18 and close and latch door 44.

A worker, who has not been exposed to contamination, peels away flaps 60*a*–60*d* from the cooperating loop-type Velcro strips provided adjacent to the entrance work area 70. Due to the negative pressure within work area 70 particulate is drawn away from the opening of the work area so that neither the side wall 18*f* and door 44 nor the worker outside the work area and assigned to push the people mover 10 to the decon unit 80, are subjected to contamination.

Thereafter, the uncontaminated worker outside people mover 10 releases brake 16 and moves people mover 10, preferably by handle 30, to the entrance of decon unit 80 shown in FIG. 5. The flaps 60*a*–60*d* are again peeled away from the cooperating strips 68 and pressed against the cooperating strips surrounding the entrance to decon unit 80 to provide a substantially airtight seal, it being understood that the worker moving the people mover preferably locks the brake assembly by operating brake pedal 16 prior to release of the flaps 60*a*–60*d* from strips 68.

After flaps 60*a*–60*d* are pressed against the cooperating loop-type strips arranged about the entrance to decon unit 80, the contaminated workers then open door 44 into the first airlock region 82, it again being noted that the door opens into the opening to assure that the seal between the decon unit and the people mover is unaffected. Door 44 may then be closed, flaps 60*a*–60*d* may be peeled away from the decon unit entrance and moved so that the cooperating strips of the flaps 60*a*–60*d* and the strips 68 interengage to retain the flaps substantially flush against the exterior of the people mover. The people mover may then be returned to the work area 70, for example, in order to move additional personnel or unit 10 may be moved to another like work area for transportation of contaminated personnel to the decon unit.

The work area 70 air lock and decon unit air lock 82 are typically maintained so that the enclosed region is under negative pressure. The people mover is designed so that the fan or blower 26 maintains a positive pressure within the people mover so that air from within the people mover enters into the work region 70 air lock or decon unit air lock 82 when the people mover is respectively coupled with the work region or decon unit and the door to the people mover is opened into the work region or decon unit, thereby limiting contamination other than that collected upon the worker from entering into the interior of the people mover. Although uncontaminated air may enter into the people mover through opening 18*d*, the exhaust port 18*b*, which is provided with a HEPA filter, filters contaminants from the internal air before the air leaves people mover 10 to assure that unprotected regions between the protected and sealed work region 70 and the protected and sealed decon unit 80 are not contaminated due to the movement of the people mover 10 through unprotected areas.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Portable apparatus for transporting contaminated work personnel from a protected work region to a decontamination region remote from said protected work region and wherein the area between the protected work region and protected decontamination region may be unprotected, comprising:

a wheeled support frame;

an enclosure mounted upon said wheeled support frame and having a swingably mounted door arranged at one end thereof;

sealing means for providing an airtight seal between said door and said enclosure when said door is in the closed position;

said enclosure being of a size sufficient to transport at least one worker;

an inlet opening along one side wall of said enclosure;

filter means across said opening for filtering air passing therethrough;

blower means arranged along the interior side of said filter for drawing ambient air into said enclosure;

an outlet opening being provided in a roof of said enclosure;

filter means arranged across said outlet opening;

said blower means creating a positive pressure condition within said enclosure;

said filter means retaining contaminants within said enclosure while enabling air to exit from said enclosure through said outlet opening; and means provided near an end of said enclosure adjacent to said door for providing a releasable seal between an entrance into said work area and said wheeled apparatus;

said releasable seal means comprising a plurality of flaps;

each of said flaps being provided with a first type Velcro strip and the marginal portions of an entrance to said protective work region being provided with cooperating Velcro strips of a second type for interengagement with the Velcro strips on said flaps to provide a releasable seal between said portable apparatus and said protected work region.

2. The apparatus of claim 1 further comprising a portable, chargeable battery maintained within a battery compartment provided in said enclosure for powering said blower means.

3. The apparatus of claim 2 further comprising:

battery charging means arranged within said compartment for charging said battery;

an electrical power cord including means for coupling with a suitable electrical outlet to enable said battery to be charged;

said compartment being sufficient in size to store said power line when not in use; and said compartment being sealed by a removable cover.

4. The apparatus of claim 2 wherein said enclosure is provided with an interior light powered by said battery means.

5. The apparatus of claim 1 wherein said enclosure is formed of a unitary, hollow, plastic shell.

6. The apparatus of claim 5 wherein said shell is formed of fiberglass.

7. The apparatus of claim 1 further comprising:

a second Velcro strip of a first type arranged along an opposite major surface of each flap;

a cooperating Velcro strip of said second type secured to the exterior of said enclosure for interengaging with said first type strip arranged along the opposite sides of said flaps for retaining said flaps substantially flush against adjacent surface portions of said enclosure when said flaps are not in use.

8. The apparatus of claim 1 further comprising brake means for releasably locking the wheeled transport apparatus.

9. The apparatus of claim 5 wherein said shell has an interior floor;

said interior floor having a drain to facilitate drainage of the interior of said wheeled apparatus to facilitate the drainage of a washing fluid employed to decontaminate the interior of the wheeled transportation apparatus.

10. The apparatus of claim 9 further comprising cover means for airtightly sealing the drainage opening and being removable when it is desired to decontaminate the interior of the enclosure with a washing liquid.

11. The apparatus of claim 1 further comprising a push handle arranged along one side wall of the enclosure to facilitate movement of the wheeled portable apparatus.

12. The apparatus of claim 1 wherein said filter means is a HEPA filter.

13. The apparatus of claim 1 wherein said door is hingedly mounted to said enclosure and is provided with a viewing window.

14. The apparatus of claim 1 wherein said enclosure is provided with at least one viewing window along the side wall of said enclosure.

15. The apparatus of claim 1 wherein said wheeled support frame is a substantially, rectangular-shaped, support frame formed of elongated angle iron members rigidly joined to one another to form a substantially rectangular shaped frame; and wheels being joined to said frame by wheel support brackets.

16. The apparatus of claim 1 wherein the protected work region includes means for maintaining a negative pressure therein.

17. The apparatus of claim 1 wherein said flaps are secured to a side wall surface of said enclosure which contains an opening sealed by said door.

18. The apparatus of claim 1 wherein at least some of the flaps are secured to side wall surfaces adjacent to a side wall surface of said enclosure which contains an opening sealed by said door.

* * * * *